US010505314B1

(12) United States Patent
Yi et al.

(10) Patent No.: US 10,505,314 B1
(45) Date of Patent: Dec. 10, 2019

(54) ELECTRICAL CONNECTOR WITH A CONNECTOR POSITION ASSURANCE MEMBER FOR A SHROUDED LATCH

(71) Applicant: TE CONNECTIVITY CORPORATION, Berwyn, PA (US)

(72) Inventors: Chong Hun Yi, Mechanicsburg, PA (US); Brian Keith Weaver, Harrisburg, PA (US); Richard C. Batley, III, York Springs, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/179,186

(22) Filed: Nov. 2, 2018

(51) Int. Cl.

| | |
|---|---|
| ***H01R 13/631*** | (2006.01) |
| ***H01R 13/436*** | (2006.01) |
| ***H01R 13/641*** | (2006.01) |
| ***H01R 13/627*** | (2006.01) |

(52) U.S. Cl.
CPC ..... *H01R 13/631* (2013.01); *H01R 13/4361* (2013.01); *H01R 13/6273* (2013.01); *H01R 13/641* (2013.01)

(58) Field of Classification Search
CPC ..... H01R 13/6272; H01R 13/6275; H01R 13/631; H01R 13/4361; H01R 13/641; H01R 13/6273
USPC ..... 439/352
See application file for complete search history.

(56) References Cited

U.S. PATENT DOCUMENTS

| | | | | |
|---|---|---|---|---|
| 7,399,195 | B2 | 7/2008 | Kim et al. | |
| 8,016,606 | B1 | 9/2011 | Kwan et al. | |
| 9,490,576 | B2 | 11/2016 | Plazio et al. | |
| 10,135,172 | B1 * | 11/2018 | Foltz | H01R 13/4368 |
| 2009/0035981 | A1 * | 2/2009 | Lim | H01R 13/4361 439/352 |
| 2015/0147901 | A1 * | 5/2015 | Wu | H01R 13/639 439/357 |
| 2016/0372867 | A1 | 12/2016 | Upson et al. | |
| 2017/0077646 | A1 * | 3/2017 | Kim | H01R 13/6272 |
| 2017/0250492 | A1 * | 8/2017 | Endo | H01R 13/426 |
| 2018/0048092 | A1 | 2/2018 | Graham et al. | |

FOREIGN PATENT DOCUMENTS

| | | | |
|---|---|---|---|
| JP | 2008235133 | A | 10/2008 |
| WO | 2011069611 | A1 | 6/2011 |

* cited by examiner

*Primary Examiner* — Gary F Paumen

(57) ABSTRACT

An electrical connector having a housing with a shrouded latch. The shrouded latch has a latch arm which extends between shrouded latch walls. The shrouded latch walls have first projections and second projections. A connector position assurance device is positioned proximate to and movable relative to the shroud latch and the latch arm between a first position and a second position. The connector position assurance includes side members with inner surfaces positioned proximate to the shrouded latch walls. The side members have first projection receiving recesses which cooperate with the first projections and the second projections when the connector position assurance device is in the first position. The side members have second projection receiving recesses which cooperate with the second projections when the connector position assurance device is in the second position.

20 Claims, 5 Drawing Sheets

ELECTRICAL CONNECTOR WITH A CONNECTOR POSITION ASSURANCE MEMBER FOR A SHROUDED LATCH

FIELD OF THE INVENTION

The present invention is directed to an electrical connector with a position assurance device. In particular, the invention is directed to an electrical connector with a connector position assurance member for use with a shrouded latch.

BACKGROUND OF THE INVENTION

In certain applications, electronic components require an electrical connector assembly that joins first and second housings containing electrical contacts. One housing includes male electrical contacts, while the other housing includes female electrical contacts. The first housing is configured to be received inside the second housing such that the male and female electrical contacts are electrically connected. To be sure that the first and second housings are properly connected with the electrical contacts, the first and second housings are provided with a latch assembly and a connector position assurance device or member (CPA). When the connector halves are mated and the latch or retention assembly is positioned to maintain contact between the connector halves, the connector position assurance member is moved to a mated or second position that indicates the connector halves are properly connected. Thus, the connector position assurance member provides a means to assure that the connector halves are fully mated. In addition, the connector position assurance member prevents the inadvertent removal of the first connector half from the second connector half when the connector position assurance member is in the mated position.

While the foregoing latch and connector position assurance members function effectively for the many connectors, connector position assurance members generally do not function well with connectors with a shrouded latch. It would be beneficial to have a connector position assurance member which is configured to be used with a shrouded latch, thereby assuring that the connector halves are fully mated and preventing the inadvertent removal of the first connector half from the second connector half when the connector position assurance member is in the mated position.

SUMMARY OF THE INVENTION

An embodiment is directed to an electrical connector having a housing with a shrouded latch extending from a top surface of the housing. The shrouded latch has a latch arm which extends between shrouded latch walls. The shrouded latch walls have first projections and second projections. A connector position assurance device is positioned proximate to and movable relative to the shroud latch and the latch arm between a first position and a second position. The connector position assurance includes side members with inner surfaces positioned proximate to the shrouded latch walls. The side members have first projection receiving recesses which cooperate with the first projections and the second projections when the connector position assurance device is in the first position. The side members have second projection receiving recesses which cooperate with the second projections when the connector position assurance device is in the second position. A cross-member extends between the side members, with the cross-member having at least one beam extending therefrom. With the connector position assurance device positioned in the second position, the at least one beam cooperates with the latch arm of the shrouded latch to prevent the movement of the latch arm.

An embodiment is directed to an electrical connector having a housing and a connector position assurance device. A shrouded latch extends from a top surface of the housing. The shrouded latch has a latch arm extending between shrouded latch walls. The walls have first projections and second projections. A connector position assurance device is positioned proximate to and movable relative to the shroud latch and the latch arm between a first position and a second position. The connector position assurance device has side members with inner surfaces positioned proximate to the shrouded latch walls. The side members have first projection receiving recesses which cooperate with the first projections and the second projections when the connector position assurance device is in the first position. The side members have second projection receiving recesses which cooperate with the second projections when the connector position assurance device is in the second position. The first projection receiving recesses have first top surfaces, the first top surfaces are spaced from side walls of the side members by a distance A. The second projection receiving recesses have second top surfaces, the second top surfaces are spaced from the side walls of the side members by a distance B. The distance A is greater than the distance B. A cross-member extends between the side members, with the cross-member has at least one beam extending therefrom. With the connector position assurance device positioned in the second position, the at least one beam cooperates with the latch arm of the shrouded latch to prevent the movement of the latch arm.

An embodiment is directed to an electrical connector having a housing and a connector position assurance device. A shrouded latch extends from a top surface of the housing. The shrouded latch has a latch arm extending between shrouded latch walls. The walls have first projections and second projections, with the first projections being spaced from and offset from the second projections. A connector position assurance device is positioned proximate to and movable relative to the shroud latch and the latch arm between a first position and a second position. The connector position assurance device has first projection receiving recesses which cooperate with the first projections and the second projections when the connector position assurance device is in the first position. The connector position has second projection receiving recesses which cooperate with the second projections when the connector position assurance device is in the second position. The first projection receiving recesses have first top surfaces, with the first top surfaces spaced from side walls of the side members by a distance A. The second projection receiving recesses have second top surfaces, with the second top surfaces spaced from the side walls of the side members by a distance B. The distance A is greater than the distance B. With the connector position assurance device positioned in the second position, the connector position assurance device cooperates with the latch arm of the shrouded latch to prevent the movement of the latch arm.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
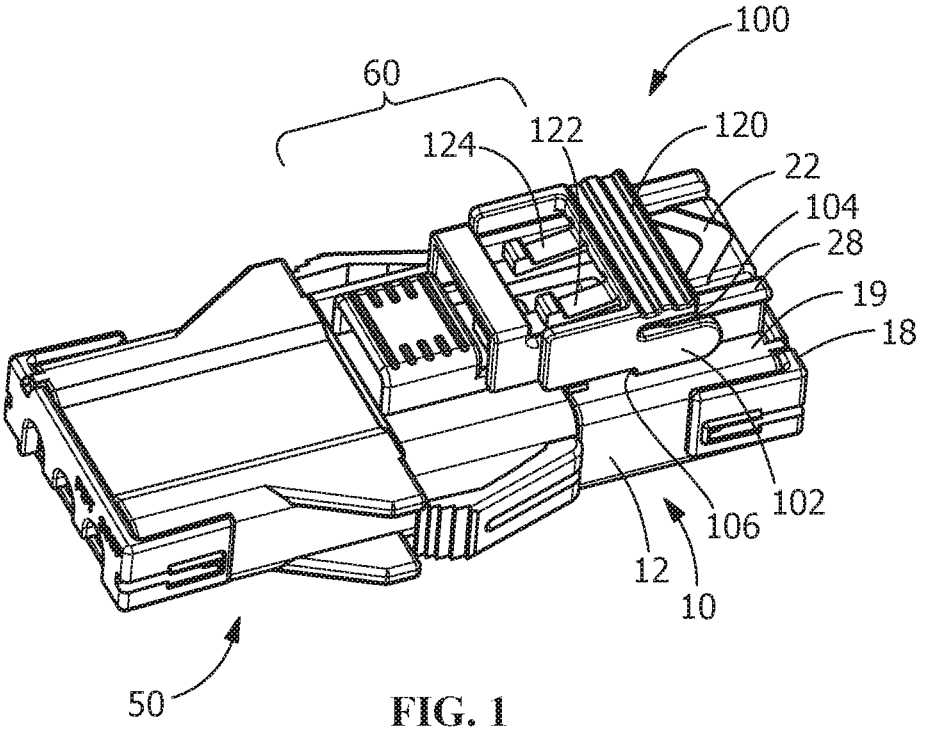
FIG. 1 is a perspective view of an illustrative electrical connector assembly with an illustrative connector position assurance member shown in an unlocked position.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

Figure 2:
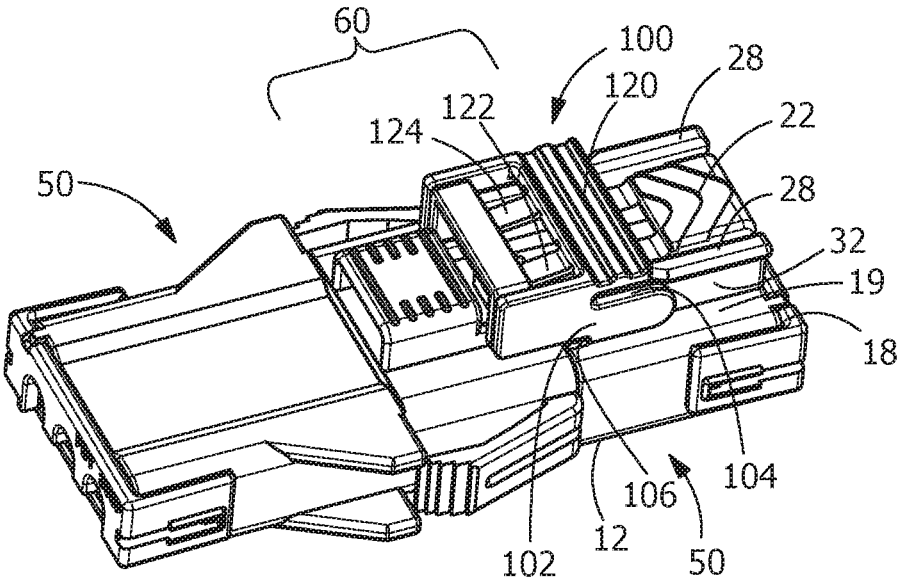
FIG. 2 is a perspective view of the illustrative electrical connector assembly of FIG. 1, with the connector position assurance member shown in a locked position.
Figure 3:
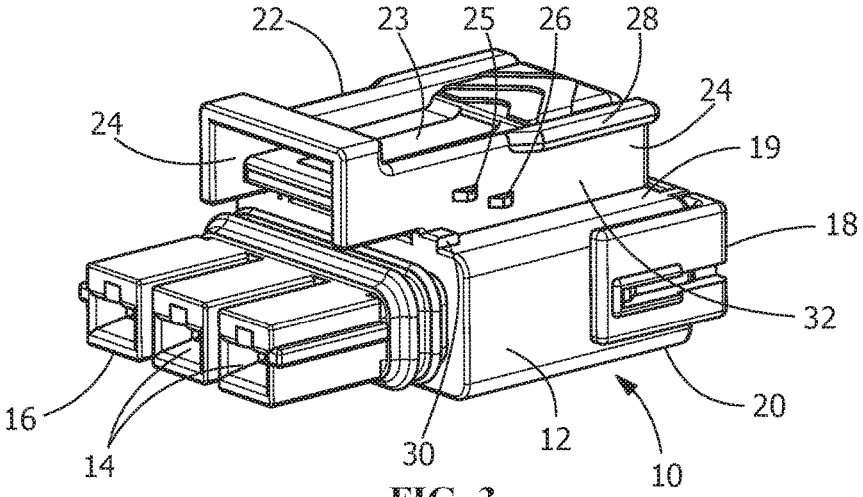
FIG. 3 is a perspective view of the male connector of the electrical connector assembly, with the position assurance member removed.
Figure 4:
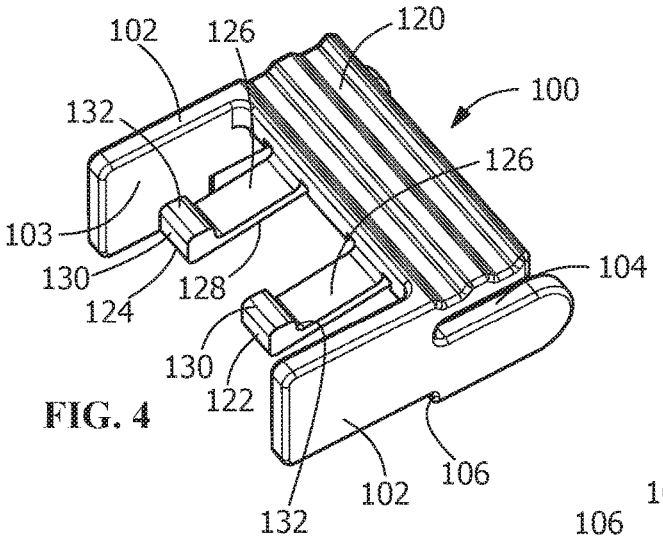
FIG. 4 is a top perspective view of the connector position assurance member removed from the male connector.
Figure 5:
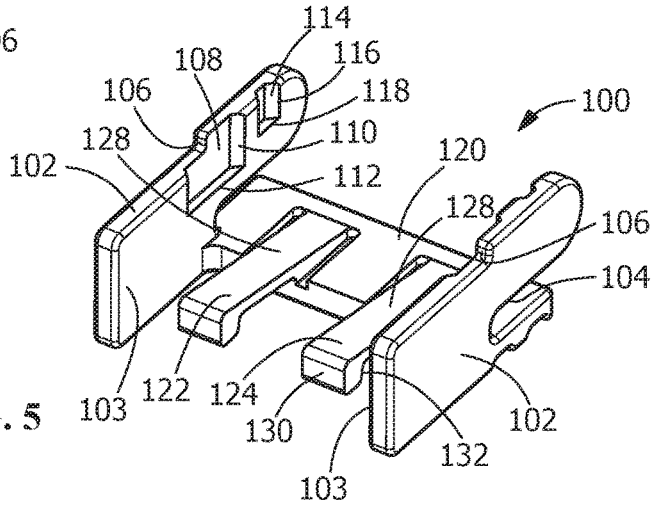
FIG. 5 is a bottom perspective view of the connector position assurance member of FIG. 4.

FIG. 3 shows a perspective view of an illustrative electrical male connector 10 onto which a connector position assurance member 100, as shown in FIGS. 4 and 5, may be inserted. As shown in FIGS. 1 and 2, the connector 10 is mated with an illustrative electrical female connector 50 to form an illustrative electrical connector assembly 60. The connectors 10, 50 are shown for illustrative purposes, as the connectors may have various configurations and different features without departing from the scope of the invention. Similarly, the connector position assurance member 100 may have different configurations without departing from the scope of the invention.

As best shown in FIG. 3, the electrical connector 10 has a housing body 12 with one or more contact receiving passages 14 for receiving one or more contacts (not shown). The electrical connector 10 has a forward mating end 16 and a rearward end 18. A first or top surface 19 and an oppositely facing second or bottom surface 20 extend between the mating end 16 and the rearward end 18.

A shrouded latch 22 extends from the top surface 19 of the housing body 12. The shrouded latch 22 has a latch arm 23 positioned between walls 24 which extend from the top surface 19. The latch arm is used to latch and secure the mating connector 50 to the connector 10, as will be more fully described below.

The walls 24 of the shrouded latch 22 have first projections 25 and second projections 26 which extend from the walls 24 in a direction away from the latch arm 22. The first projections 25 are spaced from and offset from the second projections 26. Connector position assurance cooperating walls 28 extend from the walls 24 in a direction which is essentially perpendicular to the walls 24. Connector position assurance cooperating projections 30 extend from the top surface 19. The connector position assurance cooperating walls 28 and the connector position assurance cooperating projections 30 form connector position assurance receiving recesses 32.

The connector position assurance receiving recesses 32 extend from proximate the rearward end 18 of the connector 10 toward the mating end 16 of the connector 10. The first projections 25 and second projections 26 are positioned in the connector position assurance receiving recesses 32.

The connector position assurance device 100 is positioned proximate to and is movable relative to the shroud latch 22 and the latch arm 23 of the connector 10. The connector position assurance device 100 is maintained in the connector position assurance receiving recesses 32 and is movable between a first partially inserted position or unlocked, as shown in FIGS. 1, 6, 8 and 10, and a second fully inserted position or locked position, as shown in FIGS. 2, 7, 9 and 11.

As best shown in FIGS. 4 and 5, the connector position assurance device 100 has side walls or members 102 which are essentially mirror images of each other. The sidewalls 102 have inner surfaces 103 which are positioned proximate to and/or in sliding engagement with walls 24. The side members 102 are profiled to fit in the connector position assurance receiving recesses 32, with first surfaces or sidewalls 104 positioned proximate to or slidably engaging the connector position assurance cooperating walls 28 and second surfaces or sidewalls 106 positioned proximate to or slidably engaging the connector position assurance cooperating projections 30.

The side members 102 have first projection receiving recesses 108 which extend from the second surfaces 106 and from the inner surfaces 103. The first projection receiving recesses 108 have sloped sides surfaces 110 and top surfaces 112. The top surfaces 112 are spaced from the second surfaces 106 by a distance A. The side members 102 have second projection receiving recesses 114 which extend from the second surfaces 106 and from the inner surfaces 103. The second projection receiving recesses 114 have sloped sides surfaces 116 and top surfaces 118. The top surfaces 118 are spaced from the second surfaces 106 by a distance B. The distance A is greater than the distance B.

A cross-member 120 extends between the side members 102. Two essentially parallel beams 122, 124 extend from cross member 120. In various illustrative embodiments, the beams 122, 124 may be resiliently deformable.

Each beam 122, 124 has a top side 126, a bottom side 128, and a beam front end 130. The beams 122, 124 are positioned between and spaced from sidewalls 102. The beams 122, 124 are spaced from each other. Each beam 122, 124 has an enlarged section 132 provided proximate the beam front end 130.

Referring to FIGS. 6 through 11, the progression or method of moving the connector position assurance device 100 from the initial or first position (FIGS. 6, 8, 10) to the final or second position (FIGS. 7, 9, 11) is shown.

As the connector 10 is mated with a mating connector 50, the latch arm 23 of the shrouded latch 22 is resiliently activated or deflected away from the top surface 19 of the connector 10. If the connector 10 cannot properly mate with the mating connector, for example due to improper alignment of the contacts, the continued insertion of the connector 10 into the mating connector may be prevented. If this occurs, the latching arm 23 will remain in the deflected position. In this position, the connector position assurance device 100 cannot be moved to a second or inserted position, as the front end 130 of the beams 122, 124 of the connector position assurance device 100 will engage the latching arm 23 to prevent the movement of the connector position assurance device 100 to the mated, second or inserted position.

With the connector 10 properly mated with the mating connector 50, the latching arm 23 is returned to its original or unstressed position, allowing the connector position assurance device 100 to be moved from the initial, open or first position toward the final, second or inserted position.

Figure 6:
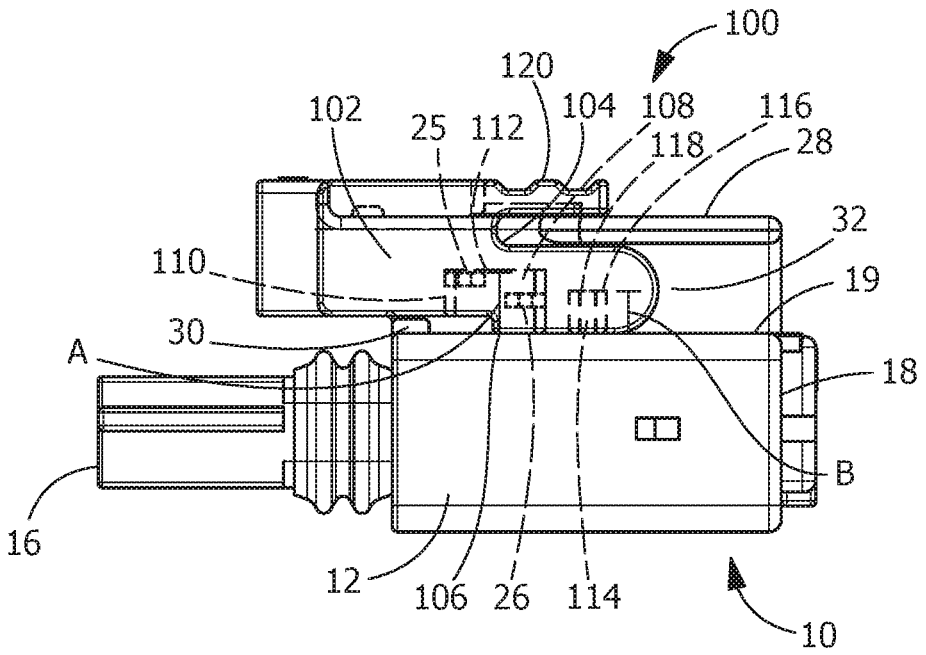
FIG. 6 is a side view of the male connector with the connector position assurance member shown in the unlocked position, the connector position assurance member is shown partially transparent to show the cooperation of the connector position assurance member with the shroud of the male connector.
Figure 7:
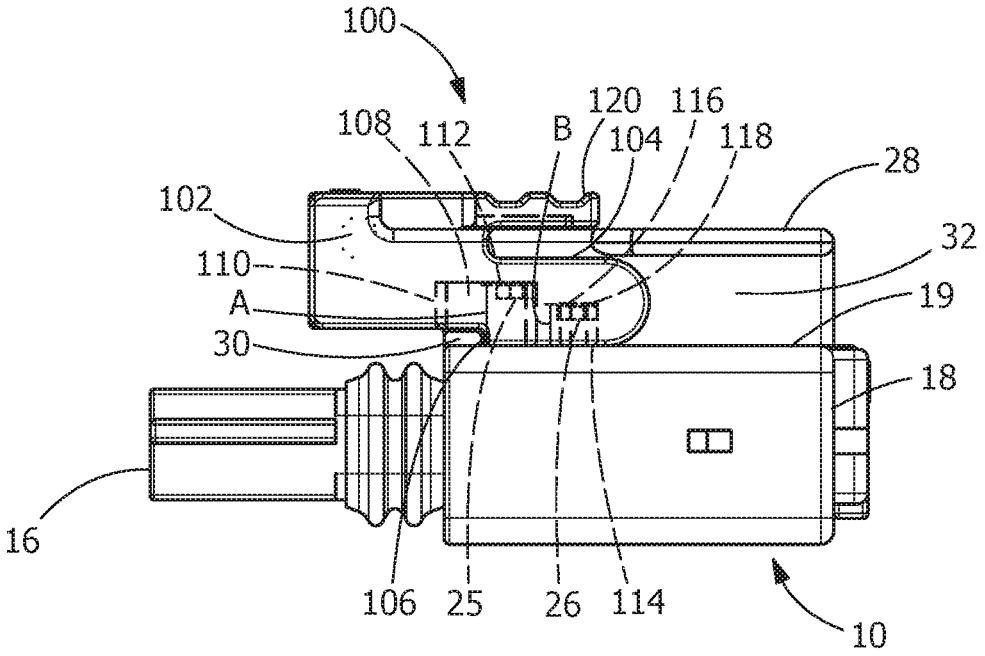
FIG. 7 is a side view of the male connector with the connector position assurance member shown in the locked position, the connector position assurance member is shown partially transparent to show the cooperation of the connector position assurance member with the shroud of the male connector.
Figure 8:
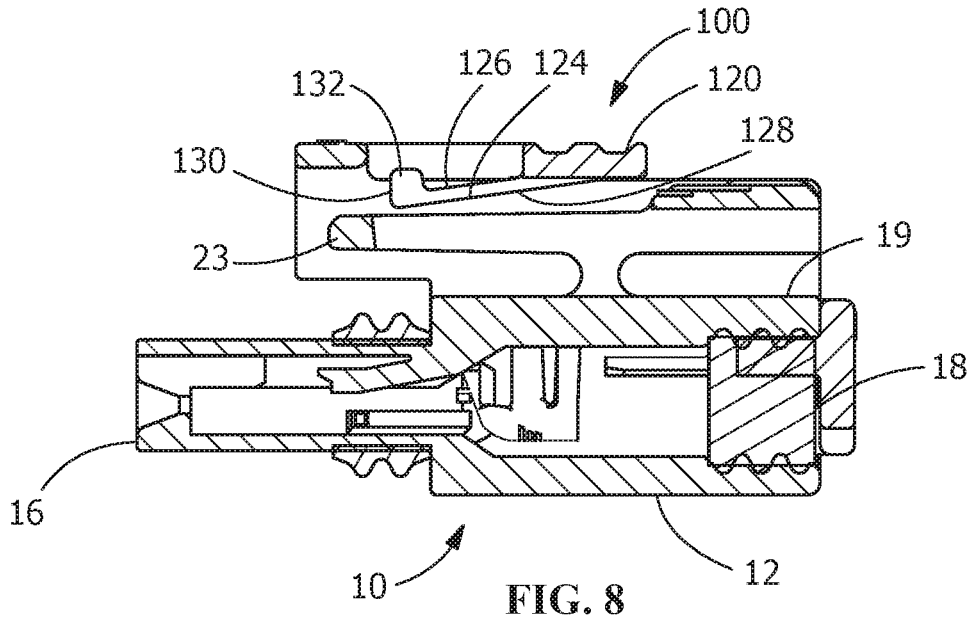
FIG. 8 is a cross-sectional view taken along the longitudinal axis of the connector assembly, showing the connector position assurance member in the unlocked position.
Figure 10:
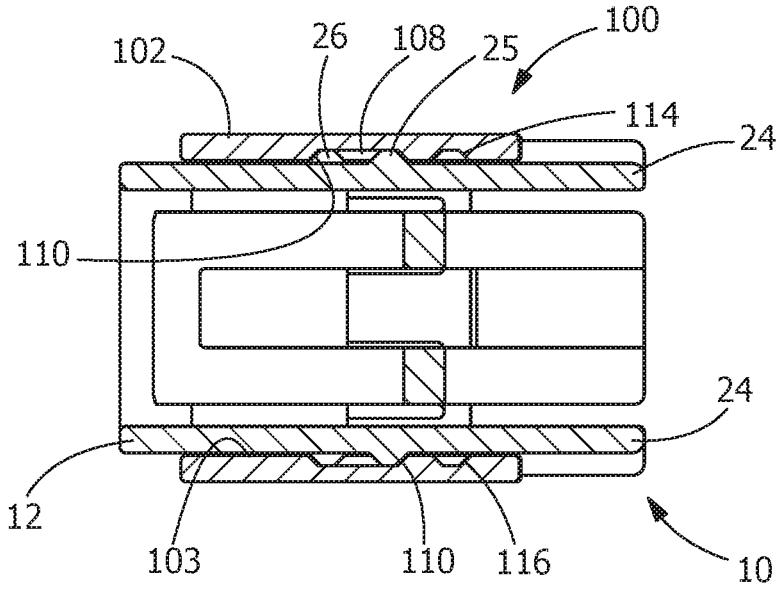
FIG. 10 is a cross-sectional view taken along line 10-10 of FIG. 1, showing the connector position assurance member in the unlocked position.
Figure 11:
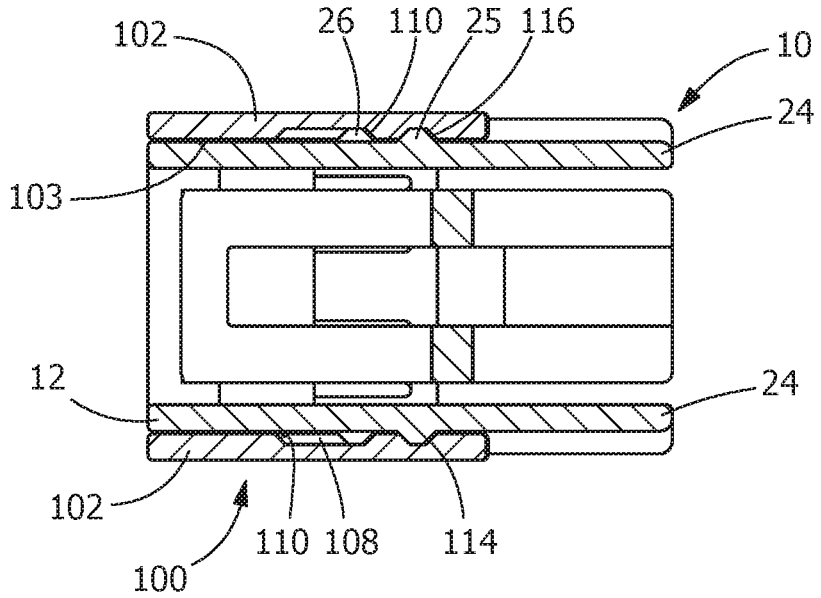
FIG. 11 is a cross-sectional view taken along line 11-11 of FIG. 2, showing the connector position assurance member in the locked position.

In the initial or first position, as shown in FIGS. 6 and 10, the side walls 102 of the connector position assurance device 100 are slidably retained in the connector position assurance receiving recesses 32. In this position, the cooperation of the first surfaces 104 of the connector position assurance device 100 with the connector position cooperating walls 28 of the shrouded latch 22 and the cooperation of the second surfaces 106 with the top surface of the connector 10 retain the connector position assurance device 100 in the connector position assurance receiving recesses 32, thereby preventing movement of the connector position assurance device 100 in any direction other than in a direction parallel to the longitudinal axis of the connector position assurance device 100 and the connector 10.

The axial movement of the connector position assurance device 100 is initially prohibited by the positioning of the first projections 25 and the second projections 26 in the first projection receiving recesses 108 of the connector position assurance device 100. In this position, the first projections 25 engage first sloped side surfaces 110 of the first projection receiving recesses 108 and the second projections 26 engage second sloped side surfaces 110 of the first projection receiving recesses 108. The spacing of the first projections 25, the second projections 26 and the sloped surfaces 110 provides an interference or frictional fit between the projections 25, 26 and the sloped surfaces 110, thereby maintaining the connector position assurance device 100 in the initial or first position, while preventing or inhibiting unwanted movement of the connector position assurance device 100.

With the connector 10 properly mated to the mating connector 50, the connector position assurance device 100 may be moved from the initial or first position to the final or second position. The assembler engages the cross-member 120 and exerts an axial force in the direction of the mating connector 50. As a sufficient force is applied, the second projections 26 engage respective sloped surfaces 110 of the first projection receiving recesses 108 causing the second projections 26 to move out of the first projection receiving recesses 108. As this occurs, the second projections 26 engage the inner surfaces 103 of the side walls 102 of the connector position assurance device 100, causing the side walls 102 to resiliently deflect away from the walls 24 of the shrouded latch 22. This allows the connector position assurance device 100 to be moved from the initial or first position to the final or second position. The amount of force required to move the connector position assurance device 100 from the initial or first position to the final or second position can be altered by altering the shape of the second projections 26, the angle of the sloped surface 110, and/or the spring rate of the side walls 102.

The movement of the connector position assurance device 100 from the initial or first position to the final or second position continues until the second projections 26 enter the second projection receiving recesses 114 of the connector position assurance device 100. As this occurs, the side walls 102 return toward their initial or unstressed position. In this position, the first projections 25 engage second sloped side surfaces 110 of the first projection receiving recesses 108 and the second projections 26 engage the sloped side surfaces 110 of the second projection receiving recesses 114. The spacing of the first projections 25, the second projections 26 and the sloped surfaces 110 of both the first projection receiving recesses 108 and the second projection receiving recesses 114 provides an interference or frictional fit between the projections 25, 26 and the sloped surfaces 110, thereby maintaining the connector position assurance device 100 in the final or second position, while preventing or inhibiting unwanted movement of the connector position assurance device 100.

Figure 9:
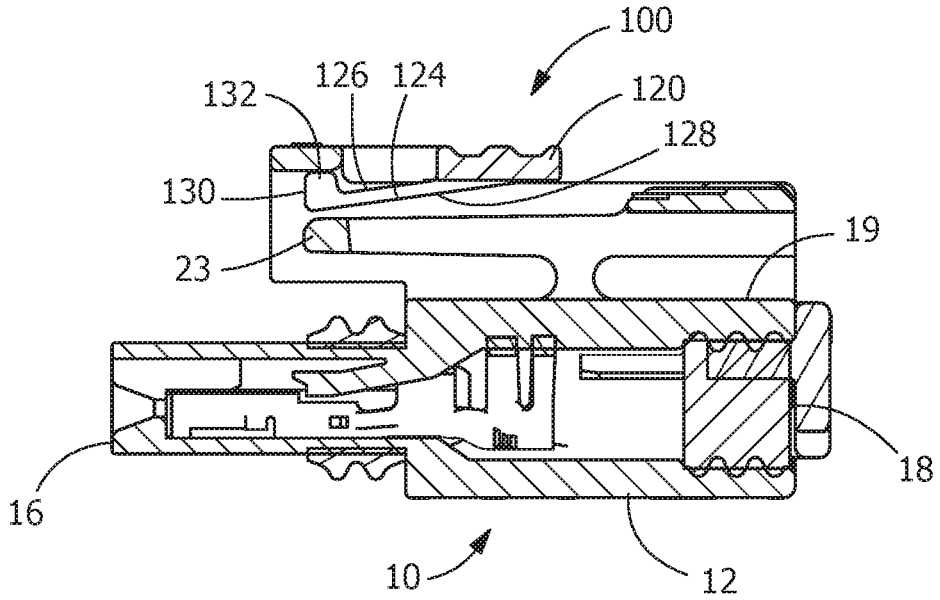
FIG. 9 is a cross-sectional view taken along the longitudinal axis of the connector assembly, showing the connector position assurance member in the locked position.

With the connector position assurance device 100 positioned in the final or second position, the enlarged sections 132 at the front end 130 of the beams 122, 124 are positioned proximate the end of the latching arm 23 (as is shown in FIG. 9, for example). In particular, the enlarged sections 132 are positioned between the end of the latching arm 23 and the cross-member 40 of the shrouded latch 22. In this position, the beams 122, 124 and the latching arm 23 have limited upward movement, as the enlarged sections 132 will engage the cross-member 40 to prevent the upward movement of the beams 122, 124 and the latching arm 23. Consequently, the latching arm 23 is prevented from disengaging the mating connector 50, thereby ensuring that the connector 10 and mating connector 50 are properly and securely mated when the connector position assurance device 100 is in the second position.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical connector comprising:

a housing;

a shrouded latch extending from a top surface of the housing, the shrouded latch having a latch arm extending between shrouded latch walls, the shrouded latch walls having first projections and second projections;

a connector position assurance device positioned proximate to and movable relative to the shroud latch and the latch arm between a first position and a second position, the connector position assurance comprising:

side members with inner surfaces positioned proximate to the shrouded latch walls, the side members having first projection receiving recesses which cooperate with the first projections and the second projections when the connector position assurance device is in the first position, the side members having second projection receiving recesses which cooperate with the second projections when the connector position assurance device is in the second position;

a cross-member extends between the side members, the cross-member having at least one beam extending therefrom;

wherein with the connector position assurance device positioned in the second position, the at least one beam cooperates with the latch arm of the shrouded latch to prevent the movement of the latch arm.

2. The electrical connector as recited in claim 1, wherein the first projections and the second projections extend from the shrouded latch walls in a direction away from the latch arm, the first projections are spaced from and offset from the second projections.

3. The electrical connector as recited in claim 2, wherein connector position assurance cooperating walls extend from the walls in a direction perpendicular to the shrouded latch walls.

4. The electrical connector as recited in claim 3, wherein connector position assurance cooperating projections extend from the top surface of the housing, the connector position assurance cooperating walls and the connector position assurance cooperating projections form connector position assurance receiving recesses.

5. The electrical connector as recited in claim 1, wherein connector position assurance receiving recesses extend from proximate a rearward end of the electrical connector toward a mating end of the electrical connector, the first projections and second projections are positioned in the connector position assurance receiving recesses.

6. The electrical connector as recited in claim 5, wherein the connector position assurance device is positioned and maintained in the connector position assurance receiving recesses.

7. The electrical connector as recited in claim 1, wherein the first projection receiving recesses have first sloped sides surfaces and first top surfaces, the first top surfaces are spaced from side walls of the side members by a distance A.

8. The electrical connector as recited in claim 7, wherein the second projection receiving recesses have second sloped sides surfaces and second top surfaces, the second top surfaces are spaced from the side walls of the side members by a distance B.

9. The electrical connector as recited in claim 7, wherein the distance A is greater than the distance B.

10. The electrical connector as recited in claim 1, wherein the at least one beam of the cross-member is two beams which are spaced from each other.

11. The electrical connector as recited in claim 10, wherein the beams have an enlarged section provided proximate beam front ends.

12. An electrical connector comprising:

a housing;

a shrouded latch extending from a top surface of the housing, the shrouded latch having a latch arm extending between shrouded latch walls, the walls having first projections and second projections;

a connector position assurance device positioned proximate to and movable relative to the shroud latch and the latch arm between a first position and a second position, the connector position assurance comprising:

side members with inner surfaces positioned proximate to the shrouded latch walls, the side members having first projection receiving recesses which cooperate with the first projections and the second projections when the connector position assurance device is in the first position, the side members having second projection receiving recesses which cooperate with the second projections when the connector position assurance device is in the second position, the first projection receiving recesses having first top surfaces, the first top surfaces spaced from side walls of the side members by a distance A, the second projection receiving recesses having second top surfaces, the second top surfaces spaced from the side walls of the side members by a distance B, the distance A is greater than the distance B;

a cross-member extends between the side members, the cross-member has at least one beam extending therefrom;

wherein with the connector position assurance device positioned in the second position, the at least one beam cooperates with the latch arm of the shrouded latch to prevent the movement of the latch arm.

13. The electrical connector as recited in claim 12, wherein the first projections and the second projections extend from the shrouded latch walls in a direction away from the latch arm, the first projections are spaced from and offset from the second projections.

14. The electrical connector as recited in claim 13, wherein connector position assurance cooperating walls extend from the walls in a direction perpendicular to the shrouded latch walls.

15. The electrical connector as recited in claim 14, wherein connector position assurance cooperating projections extend from the top surface of the housing, the connector position assurance cooperating walls and the connector position assurance cooperating projections form connector position assurance receiving recesses.

16. The electrical connector as recited in claim 15, wherein the connector position assurance receiving recesses extend from proximate a rearward end of the electrical connector toward a mating end of the electrical connector, the first projections and second projections are positioned in the connector position assurance receiving recesses.

17. The electrical connector as recited in claim 16, wherein the connector position assurance device is positioned and maintained in the connector position assurance receiving recesses.

18. The electrical connector as recited in claim 17, wherein the at least one beam of the cross-member is two beams which are spaced from each other.

19. The electrical connector as recited in claim 18, wherein the beams have an enlarged section provided proximate beam front ends.

20. An electrical connector comprising:

a housing;

a shrouded latch extending from a top surface of the housing, the shrouded latch having a latch arm extending between shrouded latch walls, the walls having first projections and second projections, the first projections are spaced from and offset from the second projections;

a connector position assurance device positioned proximate to and movable relative to the shroud latch and the latch arm between a first position and a second position, the connector position having first projection receiving recesses which cooperate with the first projections and the second projections when the connector position assurance device is in the first position, the connector position having second projection receiving recesses which cooperate with the second projections when the connector position assurance device is in the second position, the first projection receiving recesses having first top surfaces, the first top surfaces spaced from side walls of the side members by a distance A, the second projection receiving recesses having second top surfaces, the second top surfaces spaced from the side walls of the side members by a distance B, the distance A is greater than the distance B;

wherein with the connector position assurance device positioned in the second position, the connector position assurance device cooperates with the latch arm of the shrouded latch to prevent the movement of the latch arm.

* * * * *